US005630731A

United States Patent [19]

Sawada

[11] Patent Number: 5,630,731

[45] Date of Patent: May 20, 1997

[54] WATERPROOF CONNECTOR

[75] Inventor: Yoshitsugu Sawada, Shizuoka, Japan

[73] Assignee: Yazaki Corporation, Tokyo, Japan

[21] Appl. No.: 269,100

[22] Filed: Jun. 30, 1994

[30] Foreign Application Priority Data

Jun. 30, 1993 [JP] Japan ..... 5-040510

[51] Int. Cl.[6] ..... H01R 13/52

[52] U.S. Cl. ..... 439/587; 439/274

[58] Field of Search ..... 439/587, 589, 439/274, 275, 279

[56] References Cited

U.S. PATENT DOCUMENTS 4,497,531 2/1985 Baker ..... 439/587

5,151,045 9/1992 Cravens et al. ..... 439/587

*Primary Examiner*—Neil Abrams

*Attorney, Agent, or Firm*—Sughrue, Mion, Zinn, Macpeak & Seas

[57] ABSTRACT

A waterproof connector is provided of a type in which terminals are inserted by an after-fitting operation into a connector housing with a waterproof rubber plug fitted thereto, in which the rubber plug is prevented from shifting in position from the connector housing during the insertion of the terminals to thereby facilitate terminal insertion operation. A waterproof rubber plug (2) consists of an integral combination of a sealing rubber plate part (9) including a plurality of insertion holes to be in close contact with their respective terminals (A), and a shift-preventing resin plate (10) including windows (14) for arranging the insertion holes of the rubber plate part (9) therein by groups each comprising a given number of insertion holes. The resin plate (10) further includes engaging groove portions (16) which are engageable with securing projections (18) provided in a housing main body (1*a*). As a result, the waterproof rubber plug (2) can be positioned at and restricted to a given position within the housing main body (1*a*).

3 Claims, 3 Drawing Sheets

WATERPROOF CONNECTOR

BACKGROUND OF THE INVENTION

1. Field of the Invention

The present invention relates to a waterproof connector to be used in a humid place or in a place which could be flooded with water.

2. Description of the Prior Art

A conventional waterproof connector of this type, as disclosed in Japanese Patent Publication No. 62-241277 of Showa, is shown in FIG. 5. A housing 21 having a rectangular recessed portion 21*a* is stored in a case 22 with one end thereof opened, and a plurality of terminal insertion holes 23 are provided in the bottom surface of the housing 21 within the recessed portion 21*a*. A plate-shaped waterproof rubber plug 25 including a plurality of insertion holes 24 respectively corresponding to the terminal insertion holes 23 and contactable closely with the respective terminal surfaces, is fitted into the recessed portion 21*a*.

In the bottom surface of the recessed portion 21*a*, there are provided a plurality of projections 26 respectively between the terminal insertion holes 23. In the surface of the rubber plug 25 facing the bottom surface of the recessed portion 21*a*, as shown in FIG. 6, there are formed fitting holes 27 which are respectively engageable with the projections 26.

After the projections 26 are respectively engaged with the fitting holes 27 to fit the rubber plug 25 into the recessed portion 21*a*, terminals A are inserted respectively through the insertion holes 24 into the terminal insertion holes 23 to thereby assemble the waterproof connector.

In the above-mentioned arrangement, the engaging structure (consisting of the projections 26 and fitting holes 27) is provided between the housing 21 and rubber plug 25, so that the insertion holes 24 of the rubber plug 25 are arranged so as to have a shape which allows them to be in close contact with the terminals A. In other words, as shown in FIG. 7, if a plurality of terminals A are inserted sequentially through the insertion holes 24 of the rubber plug 25 into the terminal insertion holes 23, then terminal insertion forces F are applied onto the rubber plug 25 to deform the rubber plug 25 elastically. As a result, the centers of the insertion holes 24 into which the terminals have not been inserted yet are shifted from the centers of the terminal insertion holes 23. This increases the difficulty of the terminal insertion operation. The engaging structure prevents such shift of the centers of the insertion holes.

However, in the above-mentioned conventional structure, since the inherently contractible rubber plug is designed to prevent shifting of the positions of its terminals, in a multi-electrode connector including a very large number of terminals A, as shown in FIG. 7, as the terminals A are inserted one after another, the terminal insertion forces F act on the fitting holes 27 of the rubber plug 25 adjoining the terminals A to expand the fitting holes 27. This gradually increases the elastic deformation of the rubber plug 25, and thereby shifts the positions of the insertion holes 24 from those of the terminal insertion holes 23. That is, the shift preventing effect of the multi-electrode connector is lessened.

SUMMARY OF THE INVENTION

In view of the above-mentioned problems found in the conventional connector, it is an object of the invention to provide a waterproof connector which, even if it is a multi-electrode connector which includes a very large number of terminals, prevents a rubber plug from being shifted in position relative to a housing to thereby facilitate the terminals insertion operation.

In attaining the above object, according to the invention, there is provided a waterproof connector in which terminals are inserted into a connector housing through a plurality of insertion holes formed in a waterproof rubber plug fittable with the connector housing, in which the waterproof plug comprises an integrally united combination of an elastic member with the insertion holes formed therein and extending therethrough and a substantially plate-shaped shift preventing resin plate including windows for separating the insertion holes by groups, each consisting of several insertion holes and engaging recessed portions for positioning, and securing projections respectively engageable with the engaging recessed portions provided at the positions of the connector housing where the housing is feedable with the waterproof rubber plug.

Since the elastically undeformable shift preventing resin plate includes the windows for separating the insertion holes of the rubber plug by several insertion holes and is formed integrally with the rubber plug, the range of the rubber plug which is allowed to be elastically deformed is limited to the portion that is defined by the window. For this reason, even when the rubber plug is elastically deformed within the respective windows, the elastic deformation of the rubber plug is prevented from spreading to other areas, thereby being able to prevent the position shift between the insertion holes and terminal insertion holes.

Also, because the rubber plug is arranged such that a plurality of engaging recessed portions formed in the outer peripheral edge of the resin plate thereof are respectively engageable with a plurality of securing projections provided in the housing, the rubber plug can be positioned at a given position and can be fitted into the housing.

BRIEF DESCRIPTION OF THE DRAWINGS

Description will be given hereinbelow in detail of an embodiment of a waterproof connector according to the invention with reference to the accompanying drawings, in which.

DETAILED DESCRIPTION OF THE PREFERRED EMBODIMENTS

Figure 1:
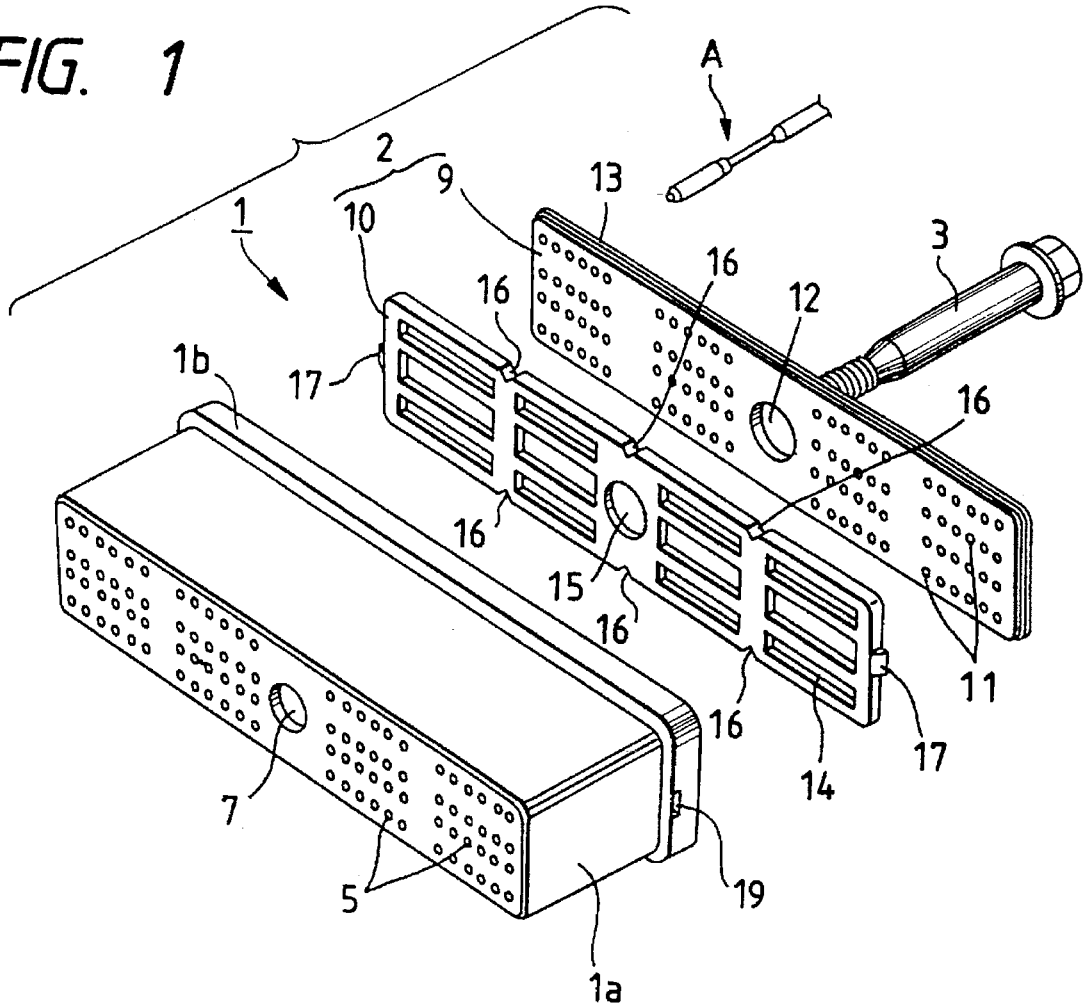
FIG. 1 is an exploded perspective view of a waterproof connector which is an embodiment of the invention.
Figure 2:
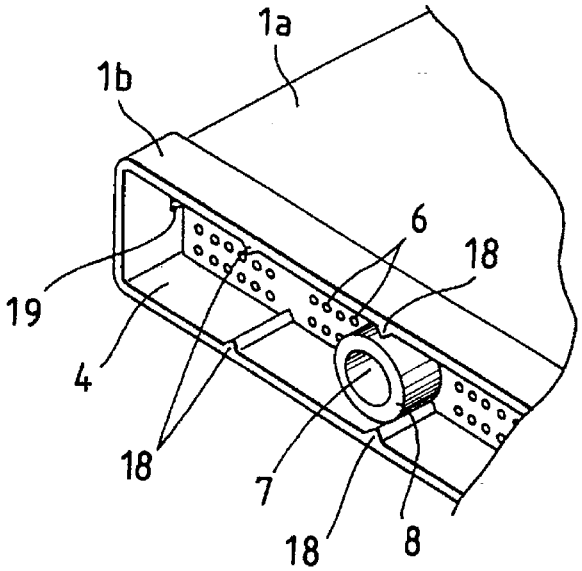
FIG. 2 is a perspective view of part of the rear portion of the connector shown in FIG. 1.

As illustrated in FIGS. 1–4, the present waterproof connector 1 includes a housing main body 1*a*, a waterproof rubber plug 2 which can be fitted into the housing main body 1*a* from the wire harness draw-out side thereof (hereinafter referred to as the rear end side), a plurality of female-type terminals A which can be respectively stored in the cavities 5 formed in the housing main body 1*a*, and a bolt 3 which is used to connect the present waterproof connector 1 with a mating connector (in the present embodiment, a male-type connector (not shown)).

The housing main body 1*a* comprises a substantially box-shaped member formed of synthetic resin material, and includes a rubber plug fitting hood part 4 (see FIG. 2), which is formed integrally with the housing main body 1*a* and of which peripheral wall 1*b* is slightly enlarged at the rear end side thereof. Also, the housing main body 1*a* includes a plurality of cavities 5 which extend through the main body 1*a* in the longitudinal direction. The cavities 5 are respectively in communication with the terminal insertion holes 6 in the rubber plug fitting hood part 4 and are opened. Further, the housing main body 1*a* includes a bolt hole 7 which extends through a central portion of the main body 1*a* in the longitudinal direction thereof, and the rear end portion of the bolt hole 7 is formed as a cylindrical guide 8 which projects into the rubber plug fitting hood part 4.

Referring to the arrangement of the cavities 5 in the present embodiment, in the housing main body 1*a*, the cavities 5 are arranged in rows of 6 cavities in the horizontal direction, or they are arranged in a rectangular matrix of 6 cavities in the horizontal direction and four cavities in the vertical direction to form a group. Four groups are then arranged in the horizontal direction. That is, each group of cavities 5 form a conventional multi-electrode connector and, therefore, the waterproof connector according to the invention consists of a structure in which two or more conventional multi-electrode connectors are collected together.

Of course, the present invention is not limited to the present embodiment in the number of cavities forming each group, the arrangement of the respective groups, or the like.

The waterproof rubber plug 2 includes a sealing rubber plate part 9, the size and Shape of which allow the rubber plate part 9 to be closely fitted into the rubber plug fitting hood part 4 and thus which provides an elastic member, and a shift-preventing resin plate 10 disposed on one surface of the sealing rubber plate part 9 opposed to the terminal insertion holes 6 when the rubber plug 2 is fitted into the rubber plug fitting hood part 4.

Figure 3:
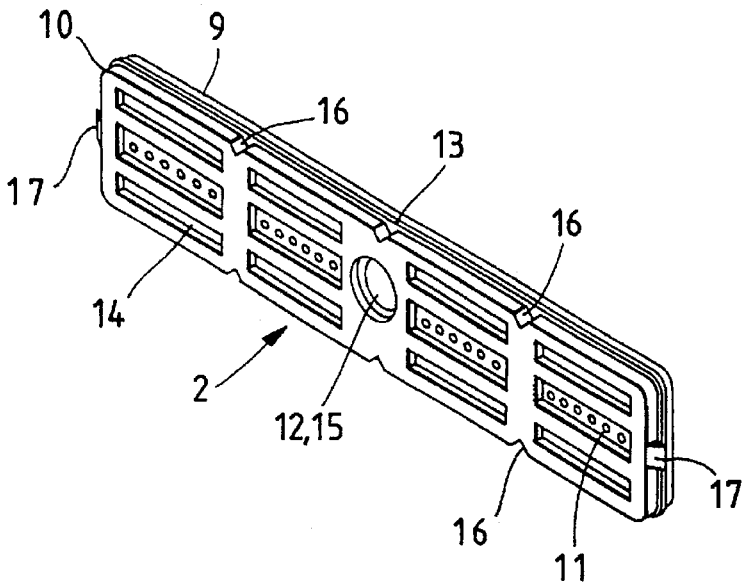
FIG. 3 is a perspective view of a rubber plug employed in the connector shown in FIG. 1.

The sealing rubber plate part 9 and shift-preventing resin plate 10, as shown in FIG. 3, are fixedly secured to each other by solid forming. In the rubber plate part 9, there are formed a plurality of insertion holes 11 arranged to correspond with the terminal insertion holes 6 of the respective cavities 5 (which will be described later) and a hole 12 for accommodating the cylindrical guide 8. A rib-shaped sealing projection piece 13 is also provided on the whole peripheral edges of the rubber plate part 9.

The shift-preventing resin plate 10 has a given plate thickness and is formed in a grid shape including windows which are long from side to side and are different in size from one another. Also, the plate 10 includes a hole 15 which is formed so as to coincide with the rubber plate part 9 for insertion of the cylindrical guide 8.

The respective windows 14 are formed such that they correspond in size and shape to the respective groups of cavities 5. The resin plate 10 and rubber plate part 9 are formed into one united body so that the insertion holes 11 of the rubber plate part 9 (corresponding to the terminal insertion holes 6) are disposed within the windows.

Also, the resin plate 10 includes on the outer peripheral edge thereof engaging groove portions 16. Groove portions 16 have an angular section and are spaced at suitable distances from one another. Resin plate 10 includes two locking claws 17 which are disposed at the two longitudinal ends thereof.

Although in the present embodiment there is employed a structure in which the rubber plate part 9 and shift-preventing resin plate 10 are fixedly secured to each other by solid forming, as a fixing means, there can be used other various known methods such as adhesives, supersonic welding and the like. However, it is not preferable to employ such fixing means which may impair, for example, the elasticity of the rubber plate part.

In the inner surface of the peripheral wall 1*b* forming the rubber plug fitting hood part 4, there are formed a plurality of rib-shaped securing projections 18 which, when the waterproof rubber plug 2 is inserted, can be engaged with the engaging groove portions 16 to guide the rubber plug 2 into the hood part 4, and two securing holes 19 which can be engaged with the locking claws 17 to fit and fix the rubber plug 2.

In the waterproof connector 1 constructed in the above-mentioned manner, the engaging groove portions 16 of the rubber plug 2 are respectively engaged with the securing projections 18, the cylindrical guide 8 is inserted into the cylindrical guide insertion holes 12, 15 to fit the rubber plug 2 into the rubber plug fitting hood part 4, and the locking claws 17 are engaged into the securing holes 19 before the rubber plug 2 is mounted to the housing main body 1*a*.

Figure 4:
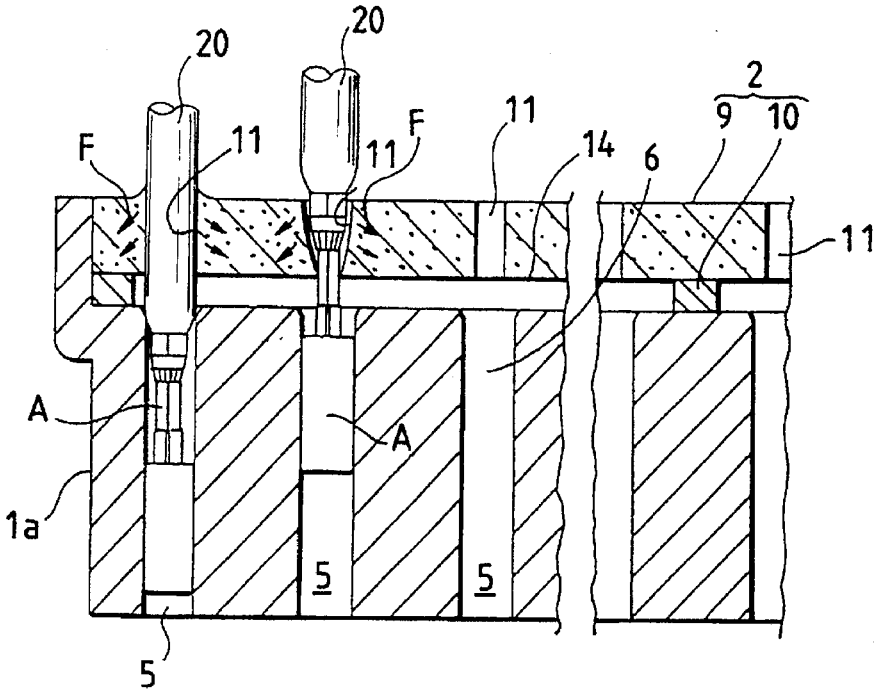
FIG. 4 is a section view of the main portions of the connector shown in FIG. 1.
Figure 5:
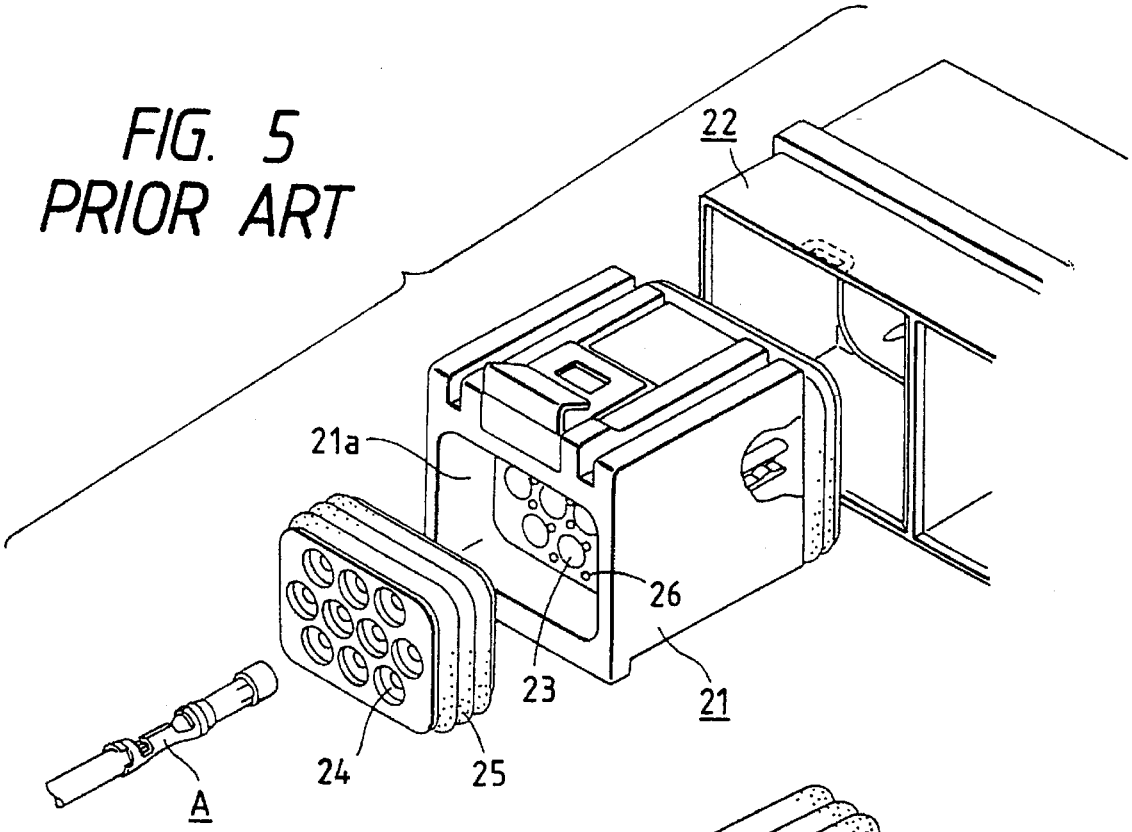
FIG. 5 PRIOR ART
FIG. 5 is an exploded perspective view of a waterproof connector having a conventional structure.
Figure 6:
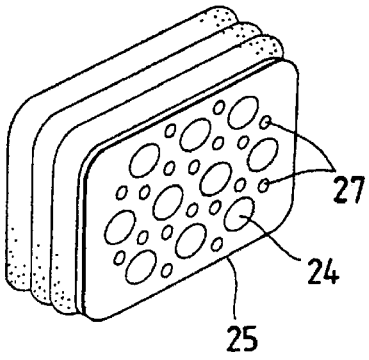
FIG. 6 PRIOR ART
FIG. 6 is a perspective view of a rubber plug applied to the waterproof connector shown in FIG. 5.
Figure 7:
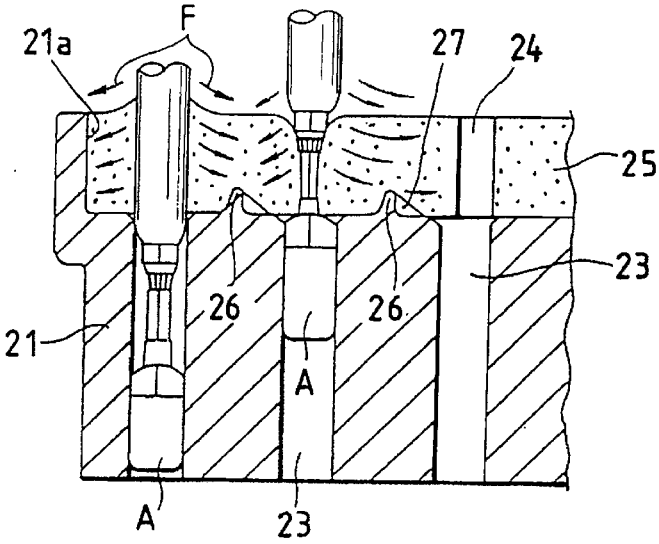
FIG. 7 PRIOR ART
FIG. 7 is a section view of a connector having a conventional structure.

In this state, the sealing projection piece 13 of the rubber plate part 9 is abutted against the inner peripheral surface of the peripheral wall 1*b* to seal a clearance between the housing main body 1*a* and rubber plug 2. Subsequently, the female-type terminals A with wires 20 connected thereto, as shown in FIG. 4, are sequentially inserted, by a conventional insertion operation through the insertion holes 11, windows 14 of the rubber plug 2 and the terminal insertion holes 6 into the cavities 5. In this operation, pressures F generated by the insertion of the terminals A act on the rubber plate part 9 in such a manner as shown by arrows, and the pressures F are going to deform the insertion holes 11 little by little to the mutually adjoining sides thereof to cause them to shift their positions. However, since the peripheral edge portions of the rubber plate part 9 are held and positioned by the resin plate 10, that is, by the respective groups of insertion holes 11, the elastic deformation of the rubber plate part 9 can be limited within the areas defined by the groups, and thus the elastic deformation of each group can be prevented from spreading to other groups. Therefore, even when the number of terminal insertion holes 6 is very large, the possibility that the insertion holes 11 can be shifted from the terminal insertion holes 6 (to make it difficult for the terminals A to be inserted) is eliminated.

In other words, even if the rubber plate part 9 is elastically deformed in each group, such elastic deformation cannot be so great as it causes pitch shift between the insertion holes 11 and terminal insertion holes 6. For this reason, the elastic deformation is not so great that it increases the difficulty of the terminal insertion operation; instead, it is in the range that allows terminal insertion.

Our experiment confirms that, as in the present embodiment, in a structure in which terminals are arranged in a rectangular matrix to form a multi-electrode connector and two or more such multi-electrode connectors are collected together, if each group is formed of 16 electrodes or less, then the pitch shift can be avoided. However, this depends on various factors such as the number and arrangement of the terminals, the size of the terminals, or the material of the rubber plate and the like.

The above-mentioned operations complete the assembly of the waterproof connector 1. After the bolt 3 is inserted through the housing main body 1*a* via the waterproof rubber plug 2, if the waterproof connector 1 is threadedly engaged with its mating connector, then the waterproof connector 1 can be connected with its corresponding mating connector.

As has been described heretofore, according to the invention, since a resin plate including grid-shaped windows for separating insertion holes by groups each consisting of several insertion holes is formed integrally with a rubber plug on the terminal insertion side of the rubber plug, the elastically deformable range of the rubber plug is limited by the resin plate to a portion defined by a plurality of insertion holes. The rubber plug insertion holes are thus prevented from being shifted in position relative to the terminal insertion holes. Further, because a plurality of engaging recessed portions formed in the outer peripheral edges of a shift-preventing resin plate are respectively engaged with securing projections provided in a housing main body, the rubber plug can be positioned at and fixed to a given position in the housing main body by the resin plate, which does not deform elastically. Therefore, even in a waterproof connector which includes a very large number of terminal insertion holes, the insertion holes of the rubber plug are prevented from being shifted in position relative to the terminal insertion holes, which facilitates the terminal insertion operation and thus improves its operability. Also, this makes it possible to perform the insertion operation automatically, which in turn can reduce the operation costs.

Further, the rubber plug can be elastically deformed in a range defined by the grid-shaped resin plate and limitations to the elastic force in the neighborhood of the insertion holes are small, so that the sealing property of the rubber plug can be improved.

What is claimed is:

1. A waterproof connector, comprising:

a connector housing; and a waterproof rubber plug, fittable with said connector housing, having insertion holes formed therethrough, said waterproof rubber plug comprising an integral combination of an elastic member with said insertion holes formed therethrough and a substantially plate-shaped shift-preventing resin plate, said shift-preventing resin plate including windows for separating said insertion holes into groups, each of said groups each comprising a plurality of insertion holes, said shift-preventing resin plate also including engaging recessed portions for positioning said waterproof rubber plug in said connector housing.

2. A waterproof connector as set forth in claim 1, wherein said shift-preventing resin plate is disposed integrally with and on the side surface of said waterproof rubber plug facing said connector housing.

3. A waterproof connector as set forth in claim 1, further comprising securing projections, disposed in said connector housing where said housing is to receive said waterproof rubber plug, which are engageable with said engaging recessed portions for positioning said waterproof rubber plug in said connector housing.

* * * * *